United States Patent [19]

Hauschke et al.

[11] 4,166,371

[45] Sep. 4, 1979

[54] EXPANDER HAVING AUTOMATIC STEPPING FEATURE

[76] Inventors: Manfred Hauschke, Im Goldgrund 4, Munnerstadt, Fed. Rep. of Germany, 8732; Volker Meissner, Fasanenweg 13, Remscheid, Fed. Rep. of Germany, 5630

[21] Appl. No.: 905,509

[22] Filed: May 12, 1978

[30] Foreign Application Priority Data

May 13, 1977 [DE] Fed. Rep. of Germany ..... 2721622

[51] Int. Cl.[2] ..... B21D 39/06

[52] U.S. Cl. ..... 72/122; 29/727

[58] Field of Search ..... 72/122; 29/157.5, 727

[56] References Cited

U.S. PATENT DOCUMENTS 3,854,314 12/1974 Martin ..... 29/727

FOREIGN PATENT DOCUMENTS 2517493 2/1977 Fed. Rep. of Germany ..... 29/157.5

*Primary Examiner*—Lowell A. Larson

*Attorney, Agent, or Firm*—J. Raymond Curtin; Barry E. Deutsch

[57] ABSTRACT

A tube expander includes a housing, a generally cylindrical cage and a mandrel movably disposed within the bore of said cage. The expander further includes an indexing system to automatically axially advance the cage relative to the housing in a step by step manner.

9 Claims, 5 Drawing Figures

11
12
13
14
15
16
16A
17
18
19
20
21
22
23
24
25
26
27
28
29
30
31
32
33
P1

EXPANDER HAVING AUTOMATIC STEPPING FEATURE

BACKGROUND OF THE INVENTION

This invention relates to tube expanders of the type used for step by step expansion of tubes into tube support sheets, and in particular, to a novel indexing device for achieving the step by step expansion.

Mechanical expansion of tubes into a tube support sheet is a well-known art and is accomplished through the use of a tool known as an expander. Generally, tube expanders include a tapered mandrel, axially movable within a support cage. Movement of the mandrel results in rollers, mounted within the cage being forced into contact with the inner surface of the tube to mechanically expand the tube. The expansion of the tubes to achieve a mechanical bond between the outer surface of the tube and the surrounding surface of the tube support sheet must be extremely accurate to prevent leaks from occurring between the contacting surfaces. In addition, if the mechanical bond is not properly achieved, any vibrations might cause relative movement between the tube and support sheet whereby a tube failure may result due to the rubbing action of the tube support sheet on the tube.

In some applications, as for example nuclear reactors, the tube support sheet is extremely thick as for example, such tube support sheet may have a thickness of 11 inches to 22 inches. In order to achieve the expansion of the tube along its entire axial surface into the surrounding tube support sheet, step tube expanders have been developed. Essentially, a step tube expander includes a mandrel disposed within a cage. The cage generally includes a plurality of circumferential grooves axially spaced thereabout. The distance between such axial grooves are generally somewhat less than the length of the rollers used in the tube expander. The cage is suitably advanced relative to the support sheet from one axial groove to the next to achieve the step by step expansion of the tube within the tube support sheet.

Heretofore, the indexing means employed to achieve the step by step advance of the cage has either been relatively expensive, or unreliable and time consuming. Inaccuracies have resulted through the use of indexing devices which require manual manipulation whereby it has been possible for an operator to skip an expansion step resulting in an improperly expanded tube. In addition, a significant amount of time has been lost as a result of the need to manually move the indexing device. Accordingly, it is a primary object of the invention to provide a simple and accurate automatic indexing device to achieve the step by step movement of the cage of an expander.

SUMMARY OF THE INVENTION

It is an object of this invention to automatically advance the cage of a tube expander to achieve step by step expansion of a tube within a tube support sheet.

It is yet another object of this invention to automatically advance a cage of a tube expander through an indexing device operable in response to the generation of forces thereon.

It is a further object of this invention to selectively develop a force on various components of a tube expander to achieve the step by step advancement of the cage of the tube expander.

These and other objects of the present invention are attained in a tube expander having a housing, a generally cylindrical cage movably supported within the housing and having an axially extending bore, and a plurality of equally spaced circumferential grooves extending about the peripheral surface thereof, and a mandrel disposed within the bore of the cage. The expander further includes indexing means to axially advance the cage relative to the housing in a step by step manner including first and second piston assemblies, each having first and second operating positions. The piston assemblies when in their first operating positions lock the cage axially relative to the housing. When the assemblies are in their second operating positions they function to advance the cage axially a predetermined distance relative to the housing. A first force is selectively applied to the first and second piston assemblies to move the assemblies from their first operating positions to their second operating positions. Opposing forces are provided to return the first and second piston assemblies to their first operating position when application of the first force to the assemblies is terminated.

DETAILED DESCRIPTION OF THE PREFERRED EMBODIMENT

Figures 1A, 1B, 1C, 1D:
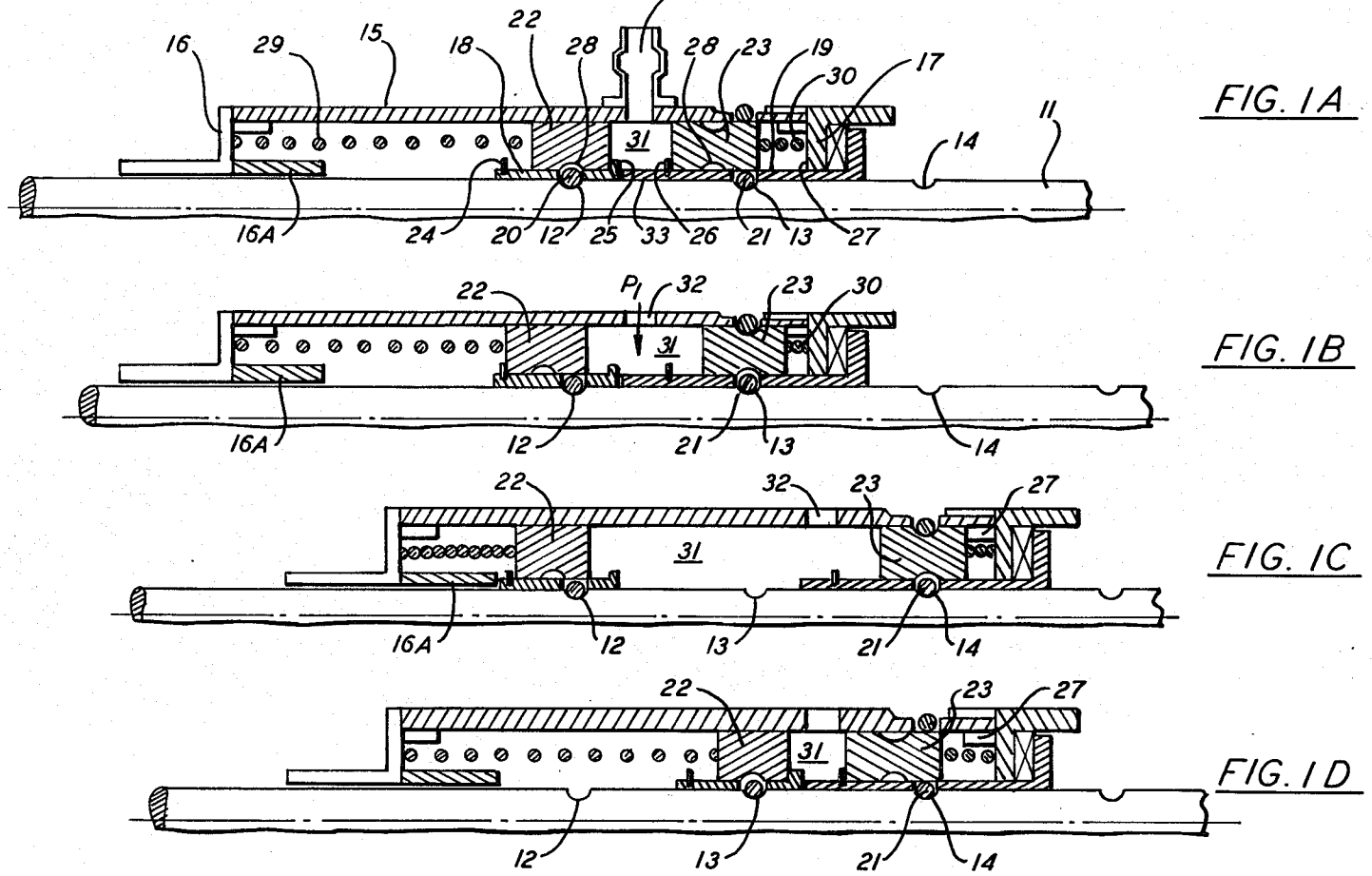
FIGS. 1A through 1D schematically illustrate the present invention through four motional phases.

FIGS. 1A through 1D schematically illustrate the tube expander indexing mechanism of the present invention which provides automatic step by step advancement of a tube expander cage relative to the housing. FIGS. 1A through 1D illustrate the various motional phases of the tube expander embodying the present invention. In particular, the tube expander includes a cage 11 mounted within a generally cylindrical housing 15. Cage 11 includes a plurality of circumferentially extending grooves 12, 13 and 14 equally spaced along the axis thereof. Housing 15 includes end walls 16 and 17.

Mounted within housing 15 about cage 11 are a pair of piston assemblies. The first piston assembly includes a movable support member 18 having a reciprocal member 22 mounted thereon. The second piston assembly includes a non-movable support member 19 having a reciprocal member 23 mounted thereon. Each support member 20 and 21 includes circumferentially spaced slots having joining means 20 and 21 respectively disposed therein. Essentially, joining means 20 and 21 comprise a row of balls or other suitable elements whose diameter corresponds to the radius of grooves 12, 13 and 14. Reciprocal members 22 and 23 are limited in their axial travel by stops 24, 25 and 26, mounted respectively on support members 18 and 19 and stop 27 comprising the inner surface of wall 17. Both reciprocal members include a groove 28 on the surface thereof facing cage 11.

A first spring 29 is disposed between end wall 16 and reciprocal member 22 to force the member against stop 25. A second spring 30 is provided between end wall 17 and reciprocal member 23 to force that member against stop 26. A space 31 is provided between the opposed ends of reciprocal members 22 and 23. Space 31 is connected to a suitable conduit 32 provided to deliver a pressurized fluid, as for example air, to space 31. To fix the minimum size of space 31, support member 19 includes an extension 33 which abuts against the adjacent end of support member 18 as shown in FIG. 1A.

The basic operation of the tube expander described herein above is thus: FIG. 1A illustrates the various components of the expander in a first operating position. In this position, the rollers (not shown) of the tube expander are forced into engagement with the inside surface of the tube by suitable movement of the mandrel (also not shown) to achieve the mechanical bonding of the tube to a tube support sheet. After such expansion of the tube has been obtained, it is desired to axially advance the cage of the expander to achieve expansion of the tube at an axially advanced position.

To obtain the desired axial advancement of cage 11, the pressurized fluid is delivered through conduit 32 into space 31. The pressure of the fluid developed in space 31 is greater than the spring forces developed by springs 29 and 30 thereby resulting in sequential movement of various components of the expander.

As shown in FIG. 1B, initially reciprocal member 23 is moved relative to support member 19 whereby axial groove 28 is radially aligned with groove 13 on the mandrel. Groove 13 on the mandrel has heretofore been radially aligned with the circumferential slots on support member 19 so that joining means 21 are disposed therein. With groove 28 being radially aligned with groove 13 and the slot on support member 19 an opening is provided to permit the joining means to exit from the groove 13 to thereby permit axial advancement of cage 11.

Additionally, as shown in FIG. 1B, reciprocal member 22 is moved axially to the left relative to support member 18 to a position where it abuts stop 24. Stop 24 prevents further axial movement of member 22. In this position, groove 28 is axially spaced from any of the grooves on cage 11, as for example, groove 12.

Referring to FIG. 1C, the pressure of the fluid delivered to space 31 is further increased resulting in movement of members 18 and 22 as a unit to the left. The movement of member 18 is limited by stop 16A formed as an extension of end wall 16. As grooves 28 and 12 have heretofore been radially misaligned, the axial advance of members 18 and 22 results in the concurrent axial advance of cage 11. This occurs since joining means 20 is firmly secured within groove 12 and the slots of member 18 radially aligned therewith. The axial advancement of cage 11 results in the displacement of groove 13 from joining means 21 and the subsequent replacement therewith by groove 14.

After the desired axial advance of cage 11 has been obtained, the pressure is exhausted from space 31 with the springs 29 and 30 returning the members 18, 22 and 23 to their initial position as shown in FIG. 1A except that the slots on the movable and non-movable support members 18 and 19 are now radially aligned with the next adjacent grooves on the cage 11 in the direction the cage has been axially advanced.

Figure 2:
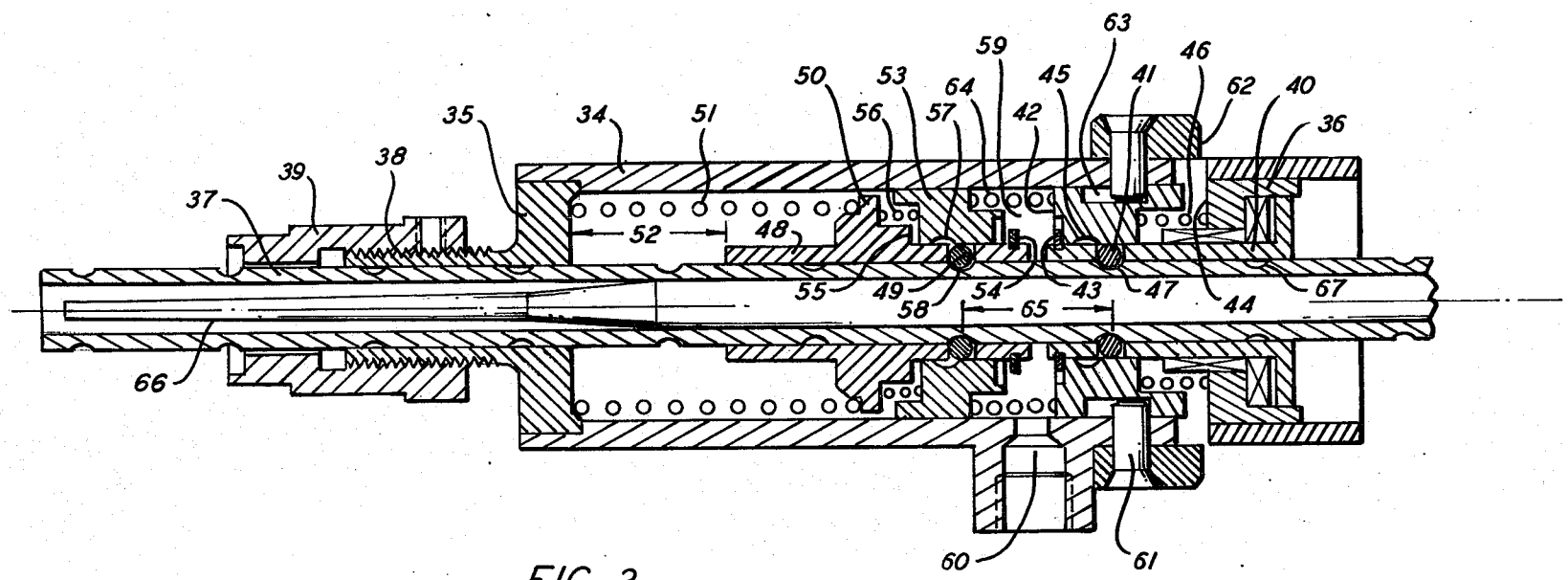
FIG. 2 is a longitudinal sectional view through a tube expander embodying the present invention.

Referring to FIG. 2, there is disclosed a detailed longitudinal sectional view of a tube expander embodying the present invention. The tube expander includes a housing 34 having end walls 35 and 36 connected thereto. The end walls circumferentially surround the expander's cage 37. Cage 37 includes an axially movable tapered mandrel 66 positioned therein. End wall 35 includes a screw thread 38 having an adjustable stop 39 mounted thereon. Stop 39 is provided to fix the position of the expander relative to the end of a tube support sheet wherby the front surface of the stop abuts the end surface of the tube support sheet. The expander includes a pair of piston assemblies with one piston assembly having a stationary support member 40 mounting thereon a reciprocal member 42. The other piston assembly includes an axially movable support member 48 having a reciprocal member 53 mounted thereon. Non-movable support member 40 has a circumferentially extending slot in which joining means or roller segments 41 are mounted. The axial movement of member 42 relative to support member 40 is controlled by limit stops 43 and 44. Reciprocal member 42 has a groove 45 disposed on its surface facing cage 37. A spring 46 is provided to urge member 42 against stop 43. In this position, joining means 41 are locked in the radially aligned slots of the support member 40 and a groove 47 formed on the peripheral surface of cage 37.

Movable support member 48 has a circumferentially extending slot having joining means 49 disposed therein. A spring 51 is arranged between end wall 35 and a flange 50 formed on movable member 48. When the force of the spring is overcome, member 48 can axially move a distance represented by the reference numeral 52 until the end of the member abuts the inner surface of end wall 35. Reciprocal member 53 is movably supported on support member 48 between stops 54 and 55. Member 53 has a groove 57 on its surface facing cage 37. Spring 56 urges reciprocal member 53 against stop 54 to normally radially align groove 57 with the slots formed on support member 48. As shown in the drawing, joining means 49 connects the support member to cage 37 through a groove 58 formed on the cage. A space 59 is provided between reciprocal members 42 and 53. Space 59 communicates with a conduit 60 carrying compressed air or other suitable pressurized fluid to the space. An L-shaped opening or slot 63 is provided in reciprocal member 42 to engage pins 61 which are suitable attached to a ring 62 mounted on housing 34. In the normal position of reciprocal member 42, pins 61 abut on the right hand end of slot 63 (as viewed in FIG. 2) towards which member 42 moves when a pressurized fluid is delivered into space 59. Ring 62 is provided to manually move member 42 into its open position with groove 45 being in radial alignment with a cage groove, e.g., groove 47.

A spring 64 is provided in space 59 between reciprocal members 42 and 53. Once the space between the members increases by more than the width of groove 45, then the force of spring 64 is exhausted.

The axial distance which support member 45 can advance, represented by reference numeral 52, matches the axial interspacing of adjacent grooves formed on cage 37 as for example, grooves 47 and 58, and as represented by numeral 65.

To achieve trouble-free, reliable and accurate operation of the expander an exact balancing of the various forces is of extreme importance. For example, the pressure selectively applied to space 59 must exceed the force developed by any one of the springs 46, 51, or 56. The force developed by spring 56 should be lower than the force developed by spring 51, and the force developed by spring 46 should be lower only to a very small degree when compared to the force developed by spring 51. The force developed by spring 64 must be lower than the force developed by spring 46 and somewhat higher than the force developed by spring 56.

Based upon the above prerequisites, the operation of the expander can be described as follows:

After an expansion of the tube has been achieved, and it is desired to axially advance the cage relative to the housing to obtain further expansion of the tube, the pressurized fluid is delivered to space 59. Once this pressure exceeds the force generated by springs 46 and 56, then reciprocal members 42 and 53 are axially shifted, with member 53 moving against stop 55 whereby the groove 57 formed on member 53 is radially misaligned with respect to groove 48, and joining means 49 is firmly locked in position within groove 58. Reciprocal member 42 is moved against stop 44 whereby grooves 45 and 47 are radially aligned to permit joining means 41 to exit from groove 47. Additional pressure is developed in space 59, axially moving the combined unit of support member 48 and reciprocal member 53 axially to the left the distance represented by reference numeral 52. This movement axially advances the cage 37 due to the engagement of joining means 49 within groove 58. The resulting movement aligns groove 67 of cage 37 with joining means 41. Space 59 is then evacuated resulting in the spring 46 axially moving reciprocal member 42 against stop 43 to firmly lock joining means 41 in groove 67. Additionally, spring 56 forces reciprocal member 53 against stop 54 to permit joining means 49 to exit from groove 58. Spring 51 thereafter moves support member 48 towards support member 40 resulting in joining means 49 entering into groove 47. This action is further facilitated by spring 64.

Once the cage has been axially advanced, the mandrel will move relative to the expander's rollers to form the desired mechanical bond. A suitable controller can be employed to supply or evacuate the pressurized fluid to or from space 59.

As may readily be observed, the above described action results in the axial advancement of the cage relative to the housing. Such advancement is achieved automatically through the use of suitable forces and is extremely reliable and accurate thereby obtaining the desired mechanical bond between a tube and a tube support sheet through the expanding of the tube surface.

While a preferred embodiment of the present invention has been described and illustrated, the invention should not be limited thereto and may be otherwise embodied within the scope of the following claims.

What is claimed is:

1. A tube expander including a housing; a generally cylindrical cage movably supported within said housing and having an axially extending bore, and a plurality of equally spaced circumferential grooves extending about a peripheral surface thereof; and a mandrel movably disposed within said bore, further comprising:

indexing means to axially advance the cage relative to the housing in a step by step manner, including first and second piston assemblies, each having first and second operating positions, with the assemblies, when in their first operating positions, locking the cage axially relative to said housing, and when in their second operating positions, advancing the cage axially a predetermined distance relative to the housing;

a first force selectively applied to the first and second piston assemblies to move the assemblies from their first operating positions to their second operating positions; and opposing force means to return the first and second piston assemblies to their first operating position when application of the first force thereto is terminated.

2. A tube expander in accordance with claim 1 wherein each of said first and second piston assemblies include a generally cylindrical support member, disposed about the cage, with one of said support members being axially fixed relative to the cage and the other of said members being axially movable relative thereto.

3. A tube expander in accordance with claim 2 wherein each support member has a plurality of circumferentially spaced slots; and joining means interposed in said slots to connect said support members to radially aligned grooves of said cage.

4. A tube expander in accordance with claim 3 further including first and second reciprocal members having grooves on the surface facing said cage and respectively mounted on said first and second support members, each of said reciprocal members being axially movable relative to its respective support member, the groove on said first reciprocal member overlying a groove on said cage with said first piston assembly in a first operating position, and the groove on said second reciprocal member being axially spaced from the grooves on said cage with said second piston assembly in a first operating position.

5. A tube expander in accordance with claims 3 or 4 wherein the slots of said movable support member are radially aligned with the grooves on said cage and said first reciprocal member when the first piston assembly is in its first operating position; and the slots of said non-movable support member are radially aligned with a groove on said cage regardless of the position of said second piston assembly.

6. A tube expander in accordance with claim 4 wherein said first force means sequentially moves said second reciprocal member, said first reciprocal member, and simultaneously said first reciprocal member and said movable support member axially relative to the cage, the movement of said second reciprocal member resulting in the groove thereon being radially aligned with the slots on said non-movable support member and a groove on said cage; movement of said first reciprocal member resulting, in sequence, said groove thereon being axially spaced from said radially aligned slots and groove respectively on said movable support member and said cage to fix the axial position of said reciprocal member relative to said movable support member; said first reciprocal member and movable support member thereafter moving axially as a unit, with movement of said movable support member resulting in concurrent axial advance of said cage through said joining means.

7. A tube expander in accordance with claim 4 including stop means to limit axial travel of said first and second reciprocal members relative respectively to said movable and non-movable support members.

8. A tube expander in accordance with claims 4 or 6 wherein the return of said first and second assemblies to their first operating position results in the groove on said first reciprocal member and the slots on said movable and non-movable support members being radially aligned with the next adjacent groove on said cage in the direction said cage is axially advanced.

9. A tube expander in accordance with claims 4 or 6, wherein the second force means includes a first, second and third springs to respectively return said movable support member, said first reciprocal member, and said second reciprocal member, to their first operating positions, with said first force being greater than the force developed by any one of said springs and with the force developed by said first spring being greater than the force developed by said second spring.

* * * * *